US005154634A

United States Patent [19]

Brown et al.

[11] Patent Number: 5,154,634

[45] Date of Patent: Oct. 13, 1992

[54] CONNECTOR HOLDING DEVICE

[75] Inventors: Jeffrey J. Brown; Jerry L. Moore, both of Harrisburg, Pa.

[73] Assignee: AMP Incorporated, Harrisburg, Pa.

[21] Appl. No.: 806,962

[22] Filed: Dec. 12, 1991

[51] Int. Cl.[5] ..... H01R 13/73

[52] U.S. Cl. ..... 439/553; 439/554; 439/555

[58] Field of Search ..... 439/544, 545, 547, 549, 439/552, 553, 554, 555, 562, 567, 568, 571, 572, 82, 83, 84, 76

[56] References Cited

U.S. PATENT DOCUMENTS

| | | | |
|---|---|---|---|
| 4,616,893 | 10/1986 | Feldman | 439/571 X |
| 4,668,040 | 5/1987 | Matsuzaki et al. | 439/571 |
| 4,907,987 | 3/1990 | Douty et al. | 439/571 |
| 5,074,807 | 12/1991 | Parmer | 439/553 |
| 5,080,611 | 1/1992 | Hypes | 439/554 X |

*Primary Examiner*—Larry I. Schwartz
*Assistant Examiner*—Julie R. Daulton
*Attorney, Agent, or Firm*—William B. Noll

[57] ABSTRACT

A holding device (50) for securing two electrical articles (22,94) together includes a U-shaped leading end (52) having a pair of leg portions (54). The U-shaped end (52) and adjacent leg portions (60) define a spring means, adapted to be received in an aperture (96) of the second article (94). The legs (54) extend to free ends (70) and define a retaining section (73) adapted to be received into a recess (32) within a housing (24). The recess (32) includes a central wall portion (42) having leading engagement sites (44), which cooperate with inner leg edges (58) to secure the device (50) within the housing (24). Upon inserting the device (50) into the housing recess (32) and the U-shaped leading end (52) of the device (50) into the second article aperture (94), compressive engagement of interference projections of the spring means with aperture wall surfaces causes legs (60) of the U-shaped leading end (52) to be moved inwardly toward each other, and concomitantly therewith the leg sections (70) in the recess (32) to pivot about the leading engagement sites (44) to move barbs (72,74) thereon into tighter engagement with the inwardly facing recess walls (38), which in turn drives the leg portions (60) of the U-shaped portion (52) outwardly to secure the articles (22, 94) together.

7 Claims, 8 Drawing Sheets

CONNECTOR HOLDING DEVICE

FIELD OF THE INVENTION

This invention relates to a device for securing electrical articles together and more particularly to securing an electrical connector to a circuit board.

BACKGROUND OF THE INVENTION

U.S. Pat. No. 4,907,987 discloses a connector with a barbed board lock including a metal member having barbs supported by spring elements that bite into interior wall surfaces of circuit board holes to lock a connector thereto. The patent teaches a variety of constructions for locking a connector and a circuit board together.

U.S. Patent application Ser. No. 07/621,407 teaches an improved board locking device wherein a planar stamped metal member includes spring beams projecting in opposite directions from a center horizontal projection. The horizontal projection engages horizontal surfaces within the components that are to be secured together. One the spring beams is secured within a cavity within a first component and the other spring beam is secured within a cavity of a second component to latch to two components together in a fixed manner. Each of the spring members have a plurality of outwardly extending barbs that engage the interior wall surfaces of the respective cavities within the components. The securing or holding power of these devices is primarily dependent upon the spring rate of the material from which the device is made as well as the shape of the spring members.

In designing board locks or other retention devices, it is desirable to minimize the amount of insertion force required to secure to two components together and at the same time maximize the retention force holding the components together. It is further desirable that a retention device be self seating that is requiring no tools to operate the device.

SUMMARY OF THE INVENTION

Accordingly the present invention is directed to a connector and holding device that alleviates problems and disadvantages associated with prior art. The invention is directed to a first electrical article to be mounted to a second article. The first electrical article includes a dielectric housing having at least one recess for receiving a device that extends into the housing from a mounting face thereof and a holding device disposed within that recess. The holding device includes a U-shaped leading end having a pair of leg portions that are joined by a bight portion and define a fastening section adapted to be received within an aperture of the second electrical article. The leg portions extend to second sections at free ends thereof and define a housing retaining section adapted to be received in the housing recess. The housing recess includes a central wall portion extending from an inner end of the recess to an outer wall proximate the mounting face and divides the recess into leg receiving portions, each configured to receive a portion of the holding device.

The holding device is substantially planar has opposed major surface with the leg portions having opposed inner and outer edges. The inner edges of the leg portions define a gap therebetween. The U-shaped leading portion and adjacent first leg portions define spring means and further include interference projections extending outwardly from the outer edges of engaging wall surfaces within the aperture of the second electrical article. The second leg sections have first and second housing engaging barbs along the outer edges, the first barbs being proximate the leading ends of the second sections and adapted to engage walls within the recess proximate the inner end thereof when the holding device is inserted into the recess. The second barbs are positioned proximate the mounting face and the inner edges of the legs are adjacent the outwardly facing surfaces of the central wall inwardly of the leading engagement sites.

Upon mounting the first article or the connector to a second article by inserting the U-shaped leading end of the holding device into the aperture of the second article, compressive engagement of the interference projections with the aperture wall surfaces causes the first leg sections adjacent the leading end to be moved inwardly toward each other. Concomitantly therewith, the second leg sections are pivoted about the leading engagement sites on the center wall of the recess within the leg receiving portions until the first barbs are moved into tighter engagement with the corresponding recess walls. This causes an increase in the retention forces and in turn drives the interference projections of the U-shaped portion more tightly against the aperture wall surfaces such that the first electrical article is held securely to the second electrical article. In the preferred embodiment , the first electrical article is a connector and the second electrical article is a circuit board.

An object of the present invention is to provide a connector and holding device that has sufficient retention force to hold the connector onto the board particularly during soldering.

It is also an object of the invention to provide a holding device that secures the device within the housing of the first article as well as secures the device to the second article.

It is an additional object of the invention to provide an improved retention or holding device for an electrical article that is actuated without the need for separate tooling.

It is a further object to provide a holding device or boardlock that acts mechanically to hold a connector to a circuit board, thereby reducing stress on any solder joints during mating and unmating of the connectors, particularly when the connector has surface mounted terminals.

An embodiment of the present invention will now be described by way of example with reference to the accompanying drawings.

DETAILED DESCRIPTION OF THE INVENTION

Figure 1:
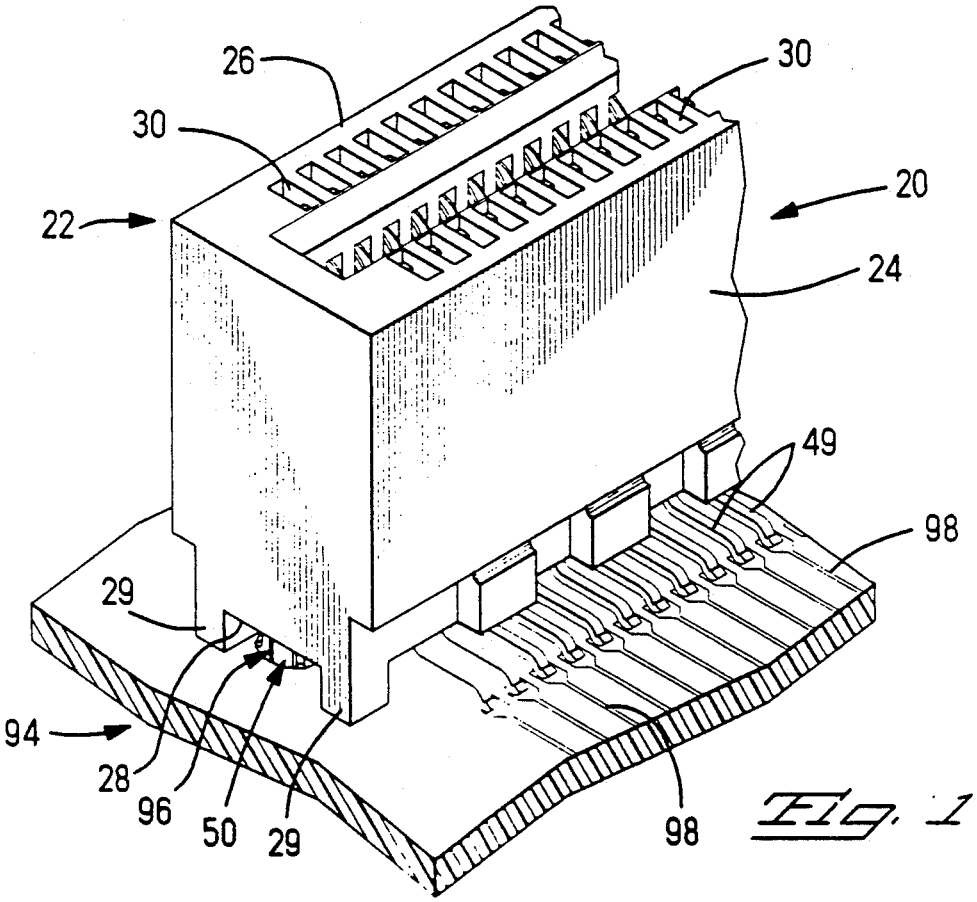
FIG. 1 is a perspective view showing portions of two electrical articles, shown representatively as an electrical connector and a circuit board, secured together in accordance with the present invention.
Figure 2:
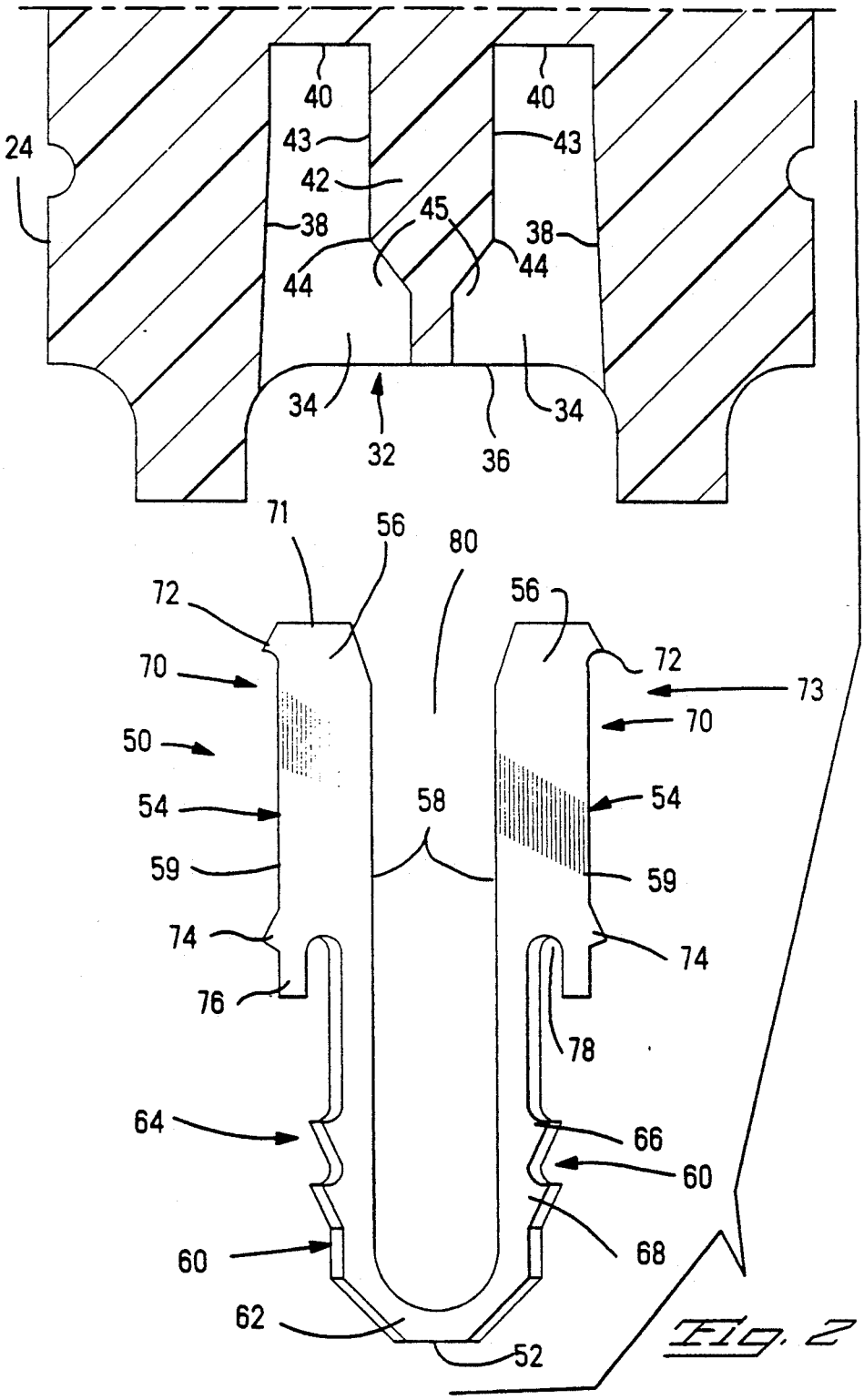
FIG. 2 is a cross sectional view of an electrical connector having a holding device exploded therefrom.
Figure 6:
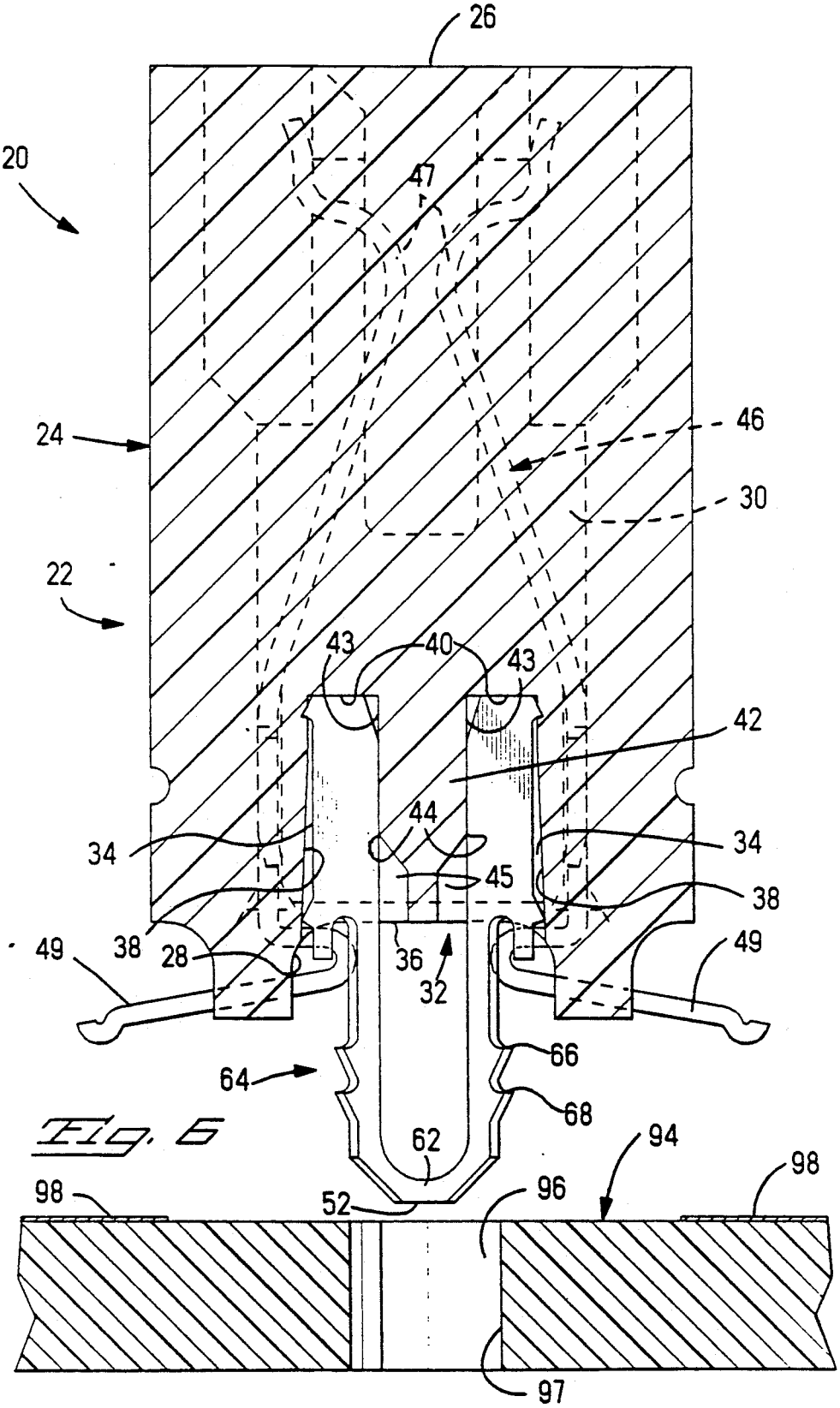
FIG. 6 is a cross sectional view of the holding device disposed within the housing recess prior to mounting the housing to the second electrical article or circuit board.

Referring now to FIGS. 1, 2 and 6, an assembly 20 includes a first electrical article or connector 22 mounted to a second electrical article or circuit board 94 and held thereon through the engagement of a holding device 50 fitted into a recess 32 of the connector housing 24 and through hole 96 of circuit board 94. For purposes of illustration, the invention is shown to secure a card edge connector 22 of the type adapted to receive a daughter card (not shown) and to interconnect pads thereof to terminals 46 shown in phantom of FIG. 6 which in turn are electrically connected to circuit pads 98 as best seen in FIG. 1. It is to be understood that the connector and circuit board are representative of the various articles with which the holding device of the invention may be used. The invention includes the positioning, aligning and holding the components together. Connector 22 includes a housing 24 having a mating face 26, an opposed mounting face 28 and a plurality of terminal receiving passageways 30 extending therebetween with a plurality of terminal members 46 disposed within respective ones of passageways 30. The mounting face 28 of housing 24 further includes standoffs 29 for cleaning under connector 22 after a soldering operation. Terminal members 46 are shown as surface mount terminals having first contact sections 47 for engaging circuits on a daughter card and second contact portions 49 for surface engagement with traces 98 of the upper surface of board 94.

Connector housing 24, as best seen in FIG. 2, includes a recess 32 extending into the housing 24 from a mounting face 28 thereof. Recess 32 is defined between an outer end 36 proximate the mating face 28, opposed inwardly facing surfaces 38 having an inner end 40. Recess 32 further includes a central wall portion 42 extending from the inner end 40 to outer wall end 36 proximate the mounting face and dividing the recess 32 into leg receiving portions 34, each configured to receive cooperating sections of the mounting device 50 as more fully explained below. Central wall 42 includes outwardly facing surface portions 43 extending from the inner recess end 40 to leading engagement sites 44 and relief recesses 45 forwardly thereof. The leg receiving portions 34 have wall surfaces defined by central wall 44 and inwardly facing recess walls 38.

Figure 4:
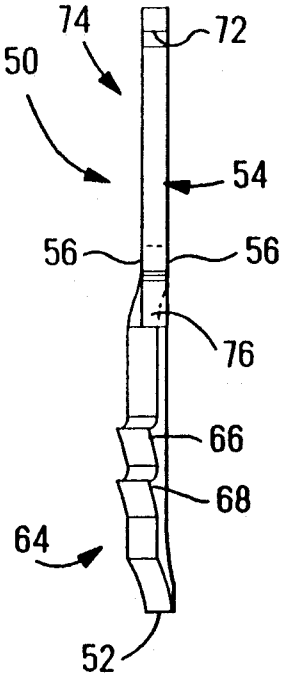
FIG. 4 is a side view of the holding device of FIG. 2.
Figure 3:
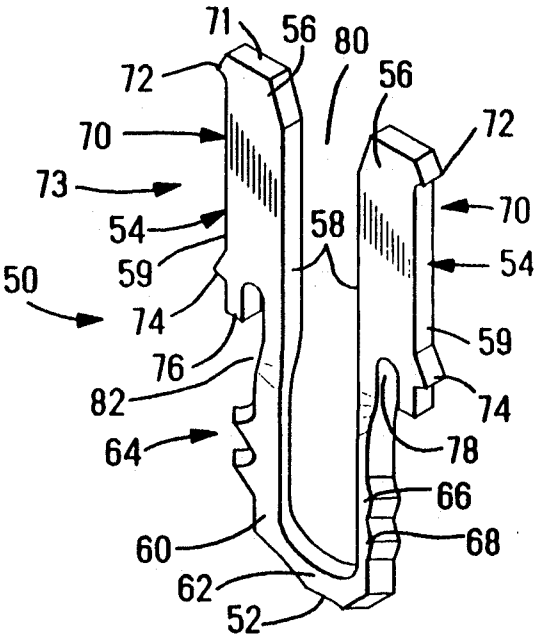
FIG. 3 is a perspective view of the holding device of FIG. 2.
Figure 7:
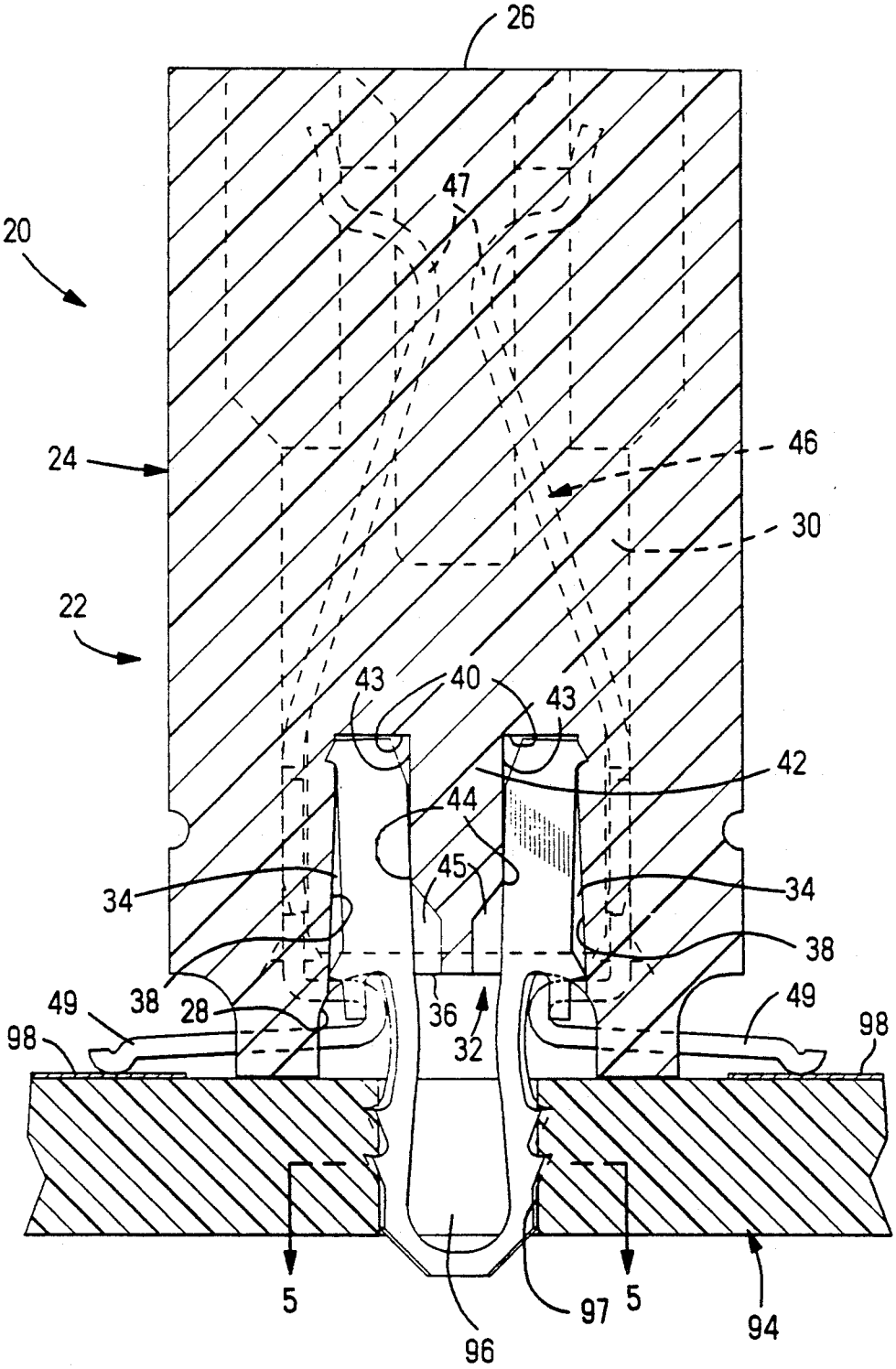
FIG. 7 is a view similar to that of FIG. 6 showing the electrical article of FIG. 6 mounted to the board.

Referring now to FIGS. 2, 3 and 4, holding device 50 includes a U-shaped leading end 52 having a pair of leg portions 54 extending upwardly therefrom. Leg portions 54 include first sections 60 which are joined by a bight portion 62 and define a spring means or fastening section 64, which is adapted to be received in aperture 96 of a second electrical article of circuit board 94, as shown in FIG. 7. The leg portions 54 extend to elongate second sections 70 at free end 71 thereof, defining a housing retaining section 73 adapted to be received into the housing recess 32. For ease in manufacturing and handling the device 50, the second leg portions 70 that are inserted into recess 32 are substantially wider than the first leg portions 60, as can best be seen in FIGS. 2 and 3. The transition between the first and second leg occurs proximate the mounting face 28 of the housing. A downward extending tab portion 76 and inwardly directed arcuate surface 78 are provided at the lower end of the second leg section to provide strain relief at the transition zone. In addition, the leading end of tab 76 provides a surface suitable to be used as a push surface by tooling used to set the holding device 50 into housing 24. As best seen in FIG. 3, the forming of the terminal with a radius of curvature occurs at 82 just immediately below the transition between the two-leg portion. This curve can also be seen from the side in FIG. 4.

Figure 8:
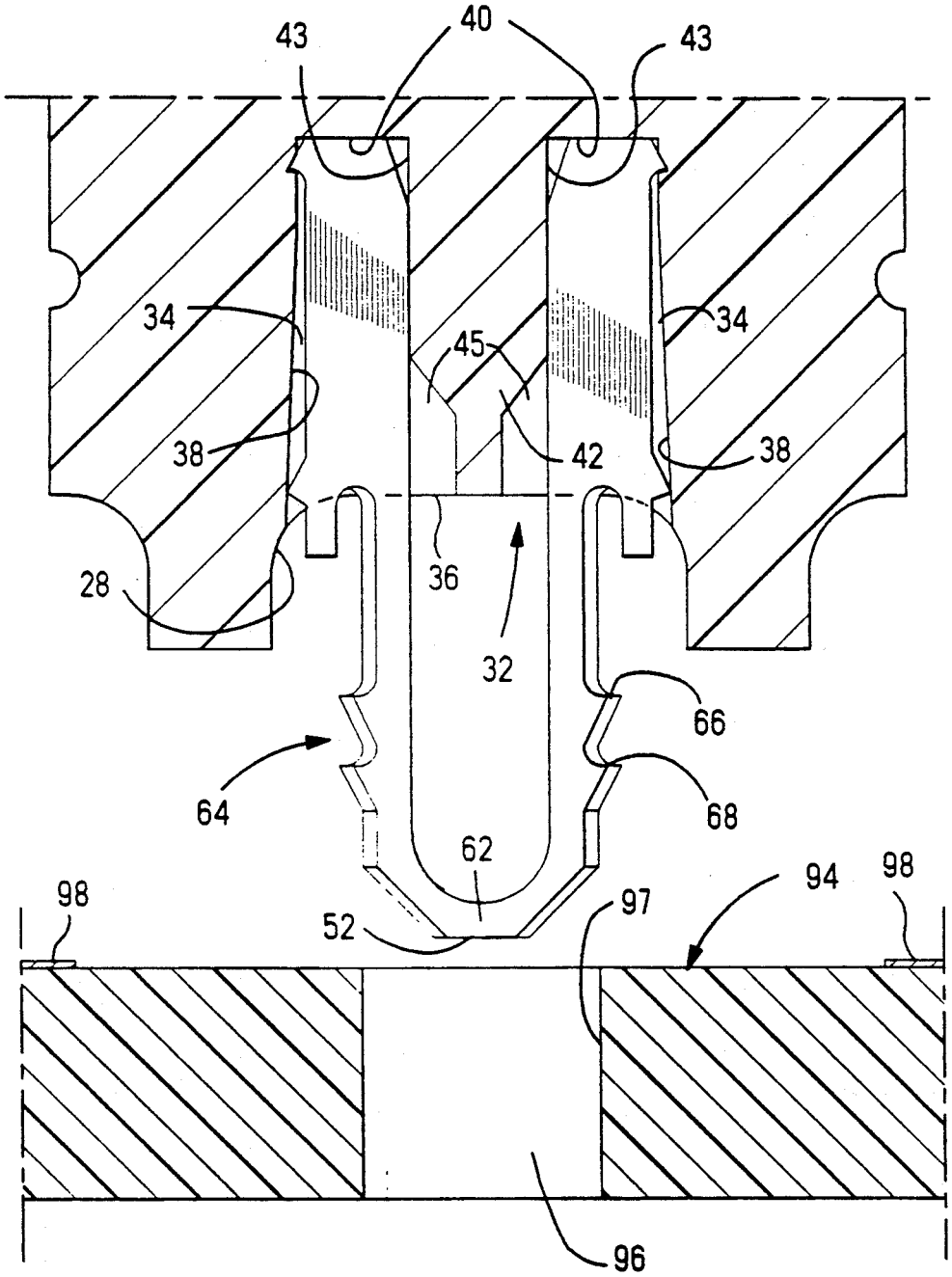
FIG. 8 is an enlarged fragmentary view of the assembly in FIG. 6.
Figure 9:
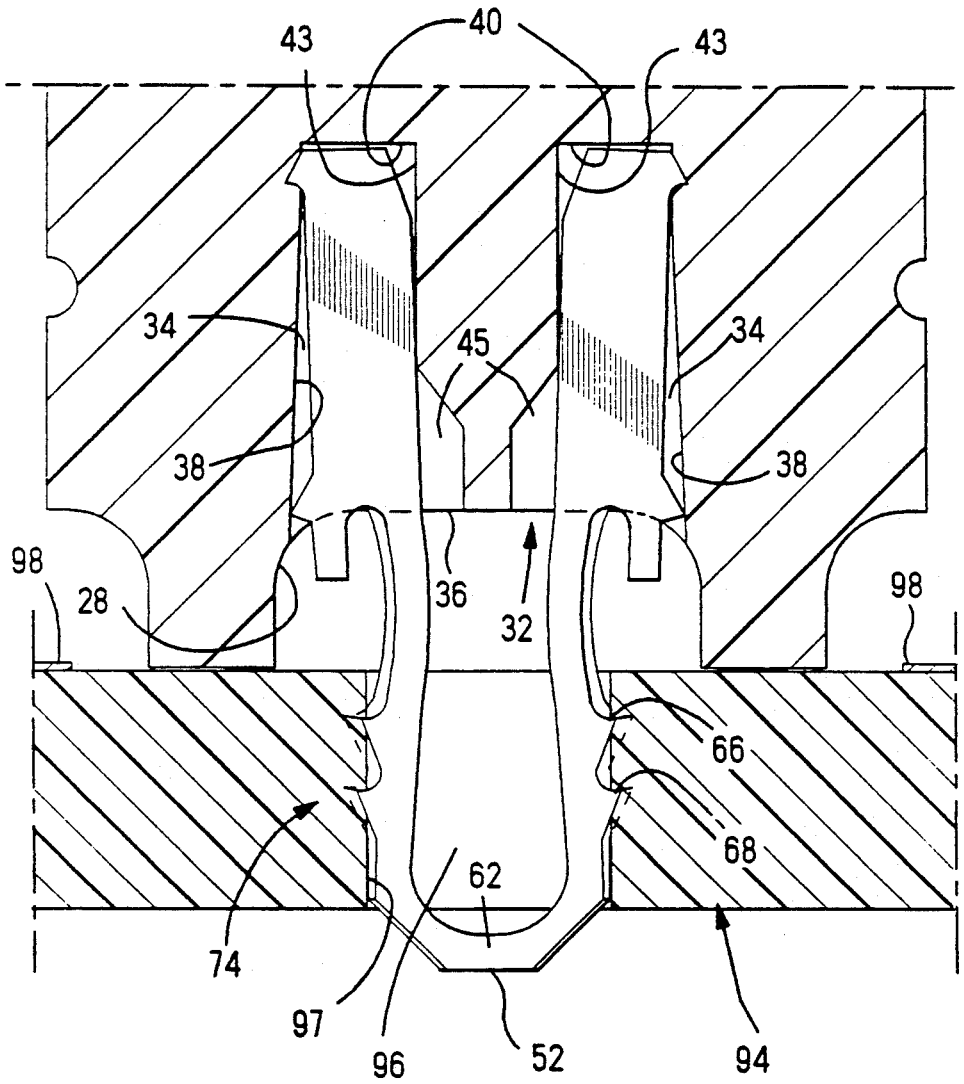
FIG. 9 is an enlarged fragmentary view of the assembly of FIG. 7.

Device 50 is substantially planar and has opposed major surfaces 56 with the leg portions 54 thereof having opposed inner and outer edges 58,59, the inner edges 58 defining a gap 80 therebetween, extending upwardly from the U-shaped leading end 52. The first leg sections 60 further have interference projections 66,68 extending outwardly along the outer edges 59 thereof. Projections 66,68 are adapted to engage wall surfaces 97 within circuit board aperture 96 upon mounting the connector 22 to the circuit board 94, as seen in FIGS. 7, and 9. The interference projections 66,68 extend outwardly to define a dimension that is greater than the selected diameter of the aperture 96 in the second article or circuit board 94. As also seen in FIGS. 2 and 3, the second leg sections 70 have first and second housing engaging barbs 72,74 spaced along the outer edge 59 thereof with the first barbs 72 being proximate the leading ends 71 thereof and the second barbs 74 being positioned proximate the connector mounting face 28. First barbs 72 are adapted to engage inwardly facing walls of recess 32 proximate the inner ends 40 thereof as best seen in FIGS. 6 and 8. Upon inserting the holding device 50 into cavity 32 such that the second leg sections 70 are received in the corresponding leg receiving recess 32 portions 34, the respective barbs 72,74 engage the inwardly facing recess walls 38, as best seen in FIGS. 6, 8 and shown in phantom in FIG. 10. The inner edges 58 of second leg sections 70 are adjacent the outwardly facing surface portions 43 of central wall 42 inwardly of the leading engagement sites 44. Insertion of device 50 is facilitated by the use of a tool pushed against the flat leading end of tab 76. The housing barbs, 72,74 engage recess walls 38 to secure device 50 in housing 24 and hold the device 50 therein until the connector or other article is to be joined to the board or other article.

Figure 10:
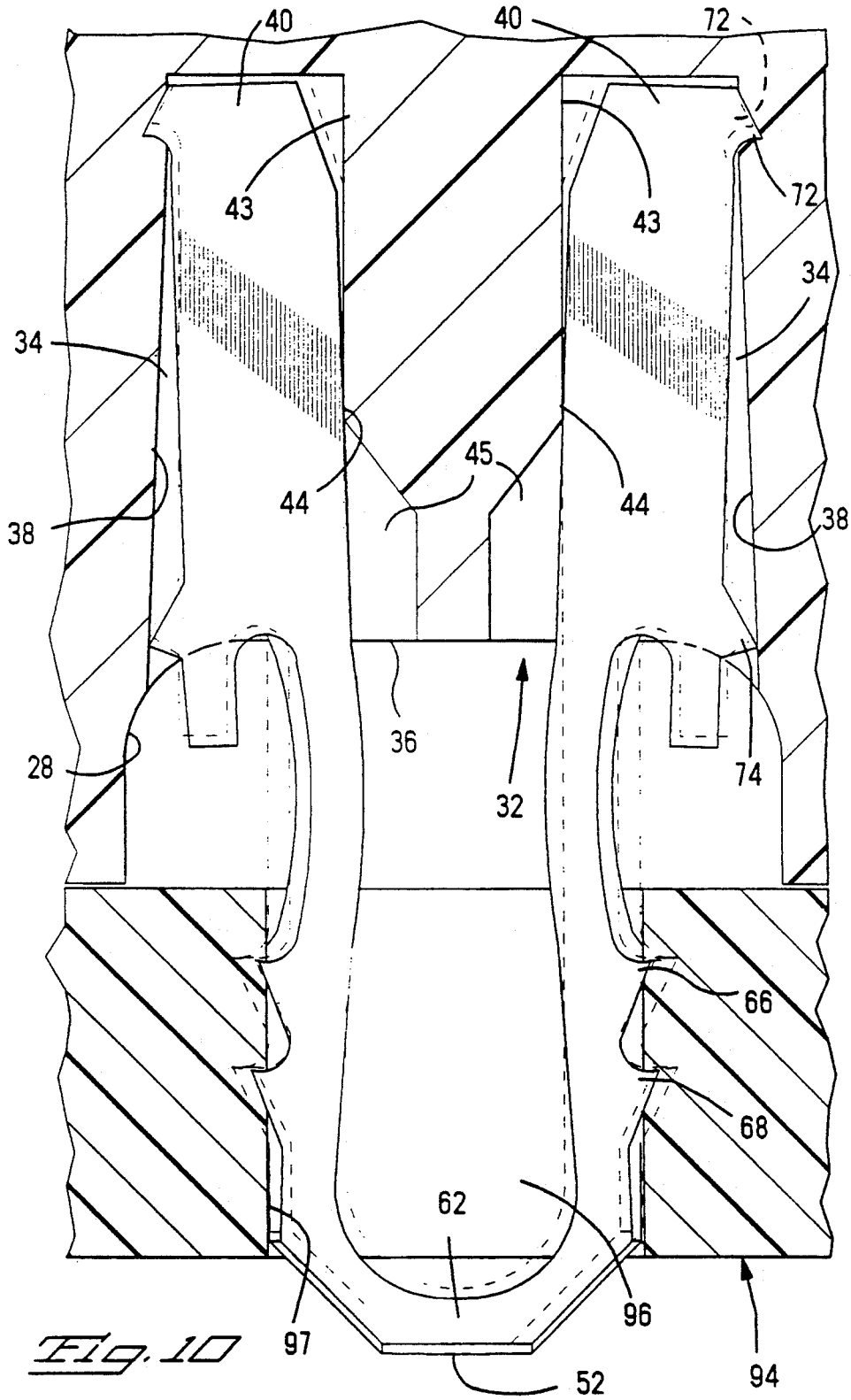
FIG. 10 is a greatly enlarged view of the housing recess and the holding device secured therein showing the first and second position of the holding device before and after mounting the housing to the circuit board, with the mounted position being shown with a solid line and the position of the device prior to mounting being shown in phantom.

Upon mounting the connector 22 to the circuit board 94 by inserting the U-shaped leading end 52 of the holding device 50 into board aperture 96, the interference projections 66,68 are placed in compressive engagement with the aperture sidewall 97 causing the first leg sections 60 of the U-shaped leading end 52 to be moved inwardly toward each other at a given spring rate, as best seen in FIGS. 7, 9 and 10. Concomitantly therewith, the second leg sections 70 are pivoted outwardly about the leading engagement sites 44 within the respective leg receiving portions 34 until the first barbs 72 are moved into tighter engagement with the inwardly facing recess walls 38 and the upper portions 70 have rotated sufficiently to obtain a double support from the housing resulting from forces generated from the interaction between inner leg surface 58 and wall engagement site 44 and the interaction between first barbs 72 and recess walls 38. Once double support has been achieved, the retention forces will increase as the connector is moved further toward the board and the resultant force will hold the connector securely to the board during subsequent manufacturing and in particular during soldering. The increased retention force in turn drives the interference projections 66,68 more tightly against the aperture wall surface 97 such that the first electrical article 22 is held securely to the second electrical article 94, as shown in FIGS. 7, 9 and 10. The relative movement of the holding device 50 within the recess 32 and aperture 96 can best be seen by referring to FIG. 10 which shows the position of holding device 50 in the unmounted connector in phantom and the position of the holding device 50 in the mounted connector by the solid lines.

Figure 5:
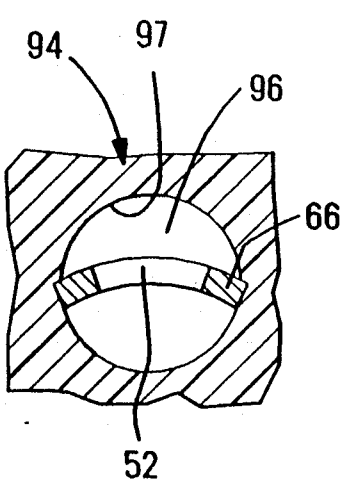
FIG. 5 is a sectional view of the holding device within an aperture of the second electrical article taken along line 5—5 of FIG. 7.

Connector housing 24 may be molded from a number of suitable dielectric materials, as known in the art. The retaining device 50 is preferably stamped from flat stock, such as copper alloys, phosphor bronze, steels or the like. Device 50 may be soldered in place or may be used solely as a mechanical holding device. If the device is to be soldered, typically the metal will plated to enhance solder wetting. The thickness and width, particularly in the spring means or lower fastening section 64, is adjusted to get a desired retention force between the connector and the board. The size of device 50 will also depend on the size of the connector, the number of devices 50 being used, the properties of the material selected and the amount of retention force exerted by each of the devices. The electrical conductivity of the selected material is not important consideration, since device 50 is not being used as an electrical terminal. In the preferred embodiment, the board retention section 60 is slightly formed by twisting at 82 as best seen in FIG. 3 in a surface of revolution of slight curvature about an axis co-parallel with the leg portions. This curvature is best seen in FIG. 5, which shows a cross-section of device 50 with the barbs 66 in engagement with the walls 97 of aperture 96.

The present invention provides an improved retention or holding device for an electrical article that is actuated without the need for separate tooling. The holding device furthermore acts mechanically to hold a connector to a circuit board, thereby reducing stress on any solder joints during mating and unmating of the connectors, particularly when the connector includes surface mounted terminals. The double support of the housing walls in cooperation with the second spring leg portions 70 assures retention of the holding device in the housing 24 as well as provides an increase in force to retain the connector and holding device to the circuit boards. The board retention means obviates the need for under board tooling and will accommodate a wide range of tolerances in both the thickness of the circuit boards and the board lock receiving apertures as well as different thicknesses of the circuit boards.

As can be appreciated, more than one holding device 50 may be used in a given connector depending on the length thereof. An appropriately configured recess may be provided in selected inner as well as outer housing walls, or may be within outwardly extending flanges. Since the device is inserted into the recess from the mounting face of the connector and is activated by the process of mounting the connector to a board or other article, access to the recess from the mating face is not necessary. Use of the holding device of the invention, therefore, does not conflict with the configuration of the mating face of the connector.

It is thought that the board retention device and connector assembly of the present invention and many of its attendant advantages will be understood from the foregoing description. Changes may be made in the form, construction and arrangement of parts thereof without departing from the spirit and scope of the invention or sacrificing all of its material advantages.

We claim:

1. A first electrical article to be mounted to a second electrical article, said first article comprising:

a dielectric housing having at least one recess for receiving thereinto a device extending into said housing from a mounting face thereof, said recess defined between opposed inwardly facing surfaces and having an inner end; and at least one holding device including a U-shaped leading end having a pair of leg portions, first sections of which are joined by a bight portion and defining a fastening section, adapted to be received in an aperture of selected diameter extending at least into said second article, said leg portions extending to elongate second leg sections at free ends thereof defining a housing retaining section adapted to be received into said recess;

said recess of said housing including a central wall portion extending from an inner end to an outer end thereof proximate said mounting face and dividing said recess into leg-receiving portions each configured to receive one of said second leg sections of said device, said central wall including outwardly facing surface portions extending from said inner end to leading engagement sites, said leg-receiving portions having wall surfaces defined by said central wall and inwardly facing recess walls;

said device being substantially planar and having opposed major surfaces and said leg portions thereof having opposed inner and outer edges, said inner edges of both of said pair of leg portions defining a gap therebetween, said U-shaped portion and adjacent first leg sections defining spring means and said first leg sections having interference projections extending outwardly along said outer edges thereof and adapted to engage wall surfaces within said aperture upon mounting said first article to said second article, said interference projections extending outwardly to define a dimension greater than said selected, diameter; and said second leg sections each have first and second housing engaging barbs spaced along said outer edges thereof, said first barbs being proximate leading ends of said respective second leg sections and adapted to engage said inwardly facing walls of said recess proximate said inner end thereof upon said device being inserted thereinto and said second barbs being positioned proximate said mounting face; and said inner edges being adjacent said outwardly facing surfaces of said central wall inwardly of said leading engagement sites; whereby upon mounting said first article to said second article by inserting said U-shaped leading end of said device into said aperture thereof, compressive engagement of said interference projections with surfaces of said aperture causes said first leg sections of said U-shaped leading end to be moved inwardly toward each other, and concomitantly therewith the second leg sections are pivoted about said leading engagement sites outwardly within respective said leg receiving portions until said first barbs are moved into tighter engagement with said inwardly facing recess walls, causing an increase in the retention forces and in turn driving the interference projections of the first leg sections more tightly against the aperture wall surface, all such that the first electrical article is held securely to the second electrical article.

2. The first electrical article of claim 1 wherein said central wall further includes relief recesses forwardly of said leading engagement sites, said relief recesses extending to said mounting face whereinto portions of the second leg sections are deflected thereinto upon said pivoting about said leading engagement sites.

3. The first electrical article of claim 1 wherein said recess of said housing is configured such that it is wider at the mounting face than at the inner end thereof.

4. The first electrical article of claim 1 wherein said second leg sections of said device are substantially wider than said first leg sections.

5. The first electrical article of claim 4 wherein said second leg section of said device further includes strain relief means at a transition area between said first and second leg sections.

6. The first electrical article of claim 1 wherein said fastening section has been formed to be disposed in a surface of revolution of slight curvature about an axis co-parallel with said leg portions.

7. The first electrical article of claim 1 wherein said first article is an electrical connector and said second article is a circuit board.

* * * * *